US008739438B1

(12) United States Patent
Deckerd et al.

(10) Patent No.: US 8,739,438 B1
(45) Date of Patent: Jun. 3, 2014

(54) WINE BOTTLE GREETING CARD

(71) Applicant: American Greetings Corporation, Cleveland, OH (US)

(72) Inventors: Annie Deckerd, Elyria, OH (US); Carol Miller, Twinsburg, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 13/925,372

(22) Filed: Jun. 24, 2013

Related U.S. Application Data

(60) Provisional application No. 61/827,045, filed on May 24, 2013.

(51) Int. Cl.
*B42D 15/02* (2006.01)
*G09F 1/06* (2006.01)
*A47G 1/06* (2006.01)

(52) U.S. Cl.
CPC ..... *B42D 15/022* (2013.01); *G09F 1/06* (2013.01); *A47G 1/0622* (2013.01)
USPC ..... 40/124.02

(58) Field of Classification Search
CPC ..... B42D 15/022; G09F 1/06; A47G 1/0622; A63F 3/00643; A63F 3/065
USPC ..... 40/124.02
See application file for complete search history.

(56) References Cited

U.S. PATENT DOCUMENTS

| | | | | |
|---|---|---|---|---|
| 5,464,092 | A | 11/1995 | Seeley | |
| 5,575,383 | A | 11/1996 | Seeley | |
| 6,418,283 | B1 | 7/2002 | Wegman et al. | |
| 6,771,165 | B2 | 8/2004 | Burg, II et al. | |
| D556,823 | S | 12/2007 | Lombard | |
| 8,176,663 | B2 * | 5/2012 | Sapp et al. | 40/124.03 |
| 8,209,892 | B2 | 7/2012 | Nielsen | |
| 8,595,961 | B2 * | 12/2013 | Mayer et al. | 40/124.03 |
| 2002/0000908 | A1 | 1/2002 | Burg, II et al. | |
| 2008/0010872 | A1 | 1/2008 | Crow et al. | |
| 2010/0252460 | A1 | 10/2010 | Nielsen | |
| 2011/0041544 | A1 | 2/2011 | Ferguson et al. | |
| 2012/0000101 | A1 * | 1/2012 | Jin et al. | 40/124.03 |
| 2012/0317850 | A1 * | 12/2012 | Guo et al. | 40/124.03 |
| 2013/0015193 | A1 | 1/2013 | Lien et al. | |
| 2013/0043205 | A1 | 2/2013 | Denison et al. | |
| 2013/0139417 | A1 * | 6/2013 | Mayer et al. | 40/124.03 |
| 2013/0232828 | A1 * | 9/2013 | Qiao et al. | 40/124.03 |

* cited by examiner

*Primary Examiner* — Charles A Fox
*Assistant Examiner* — Shin Kim
(74) *Attorney, Agent, or Firm* — Christine Flanagan

(57) ABSTRACT

The present disclosure and related inventions are directed to a greeting card in the shape of a wine bottle. A clear vacuum form is placed onto the front surface of a two-panel greeting card, creating a cavity therebetween. An intricate paper scene is disposed within the cavity, concealing various electronic components. A faux cork is attached to the greeting card at a pivot point wherein the faux cork can move between a first position where it is partially contained within the cavity and a second position where it is substantially outside of the cavity. Movement of the faux cork about the pivot point causes playback of pre-recorded audio and illumination of one or more LED lights and/or fiber optics.

20 Claims, 2 Drawing Sheets

WINE BOTTLE GREETING CARD

RELATED APPLICATIONS

This application claims priority to U.S. Provisional Patent Application No. 61/827,045, filed on May 24, 2013, a copy of which is incorporated by reference herein in its entirety.

FIELD OF THE INVENTION

The present invention is in the field of social expression products, and more specifically, interactive greeting cards.

BACKGROUND OF THE INVENTION

For many years paper greeting cards containing text sentiment and associated artwork have been widely used for celebratory occasions such as birthdays, graduations, weddings, and for other commercial purposes. More recently, greeting cards have been enhanced by incorporating sound and other special effects. Sound generating devices have been incorporated into traditional paper greeting cards to increase the entertainment value and emotional impact. In some forms, talking or musical greeting cards look just like a conventional greeting card, except that it includes a hidden sound module with a pre-recorded sound track. Opening the greeting card will automatically turn on or close a switch so that the sound module will play the pre-stored music or dialog and closing the greeting card will automatically open the switch and stop the play of the music or dialog. There is a need in the art for a greeting card that increases the entertainment value and aesthetic, and raises the surprise factor of traditional sound generating greeting cards.

SUMMARY OF THE INVENTION

The present disclosure and related inventions are directed to a greeting card in the shape of a wine bottle. A clear vacuum form is placed onto the front surface of a two-panel greeting card, creating a cavity therebetween. An intricate paper scene is disposed within the cavity, concealing various electronic components. A faux cork is attached to the greeting card at a pivot point wherein the faux cork can move between a first position where it is partially contained within the cavity and a second position where it is substantially outside of the cavity. Movement of the faux cork about the pivot point causes playback of pre-recorded audio and illumination of one or more LED lights and/or fiber optics.

DETAILED DESCRIPTION OF PREFERRED AND ALTERNATE EMBODIMENTS

Figure 1:
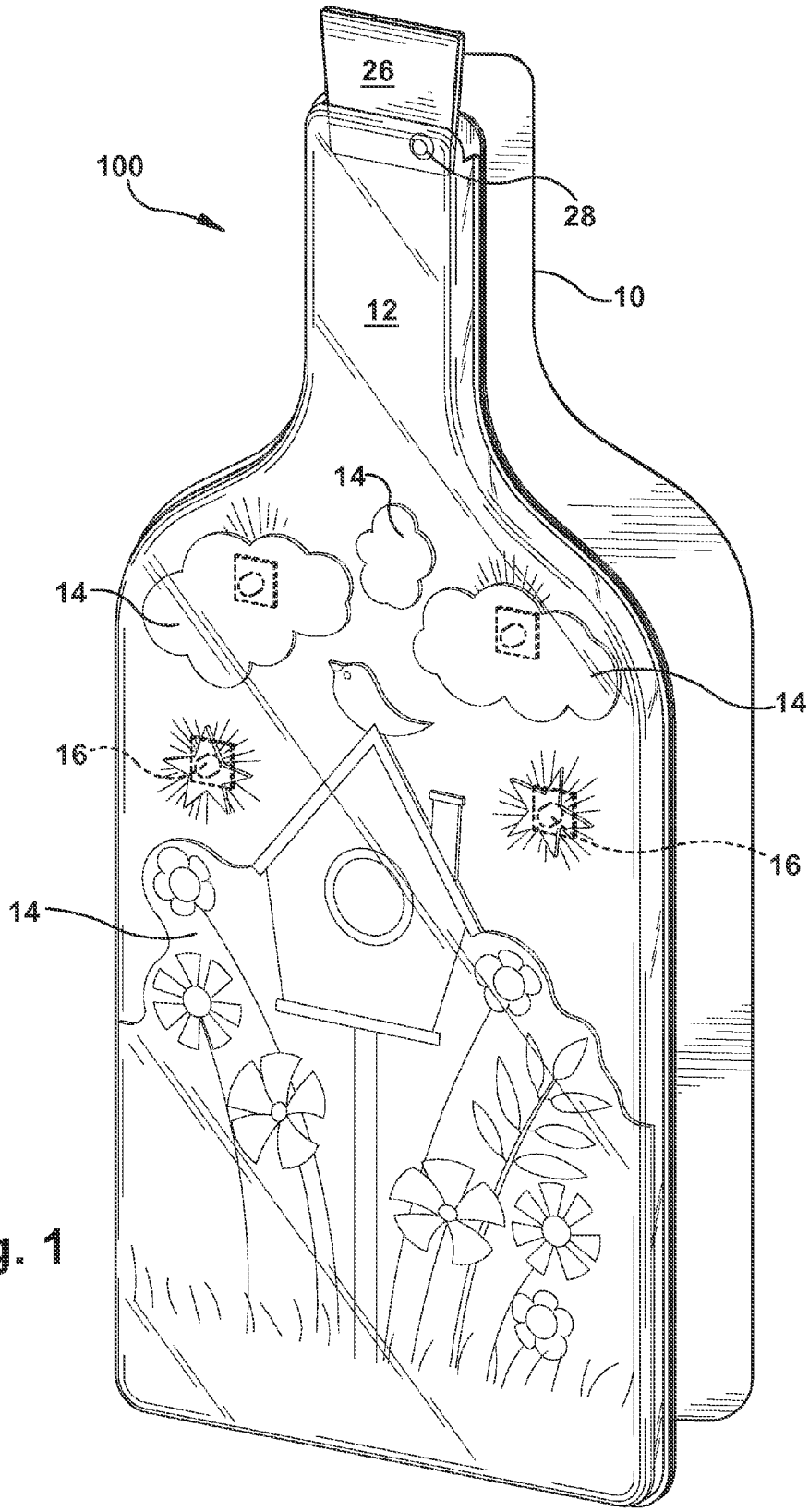
FIG. 1 is a perspective view of the greeting card of the present invention.
Figure 2:
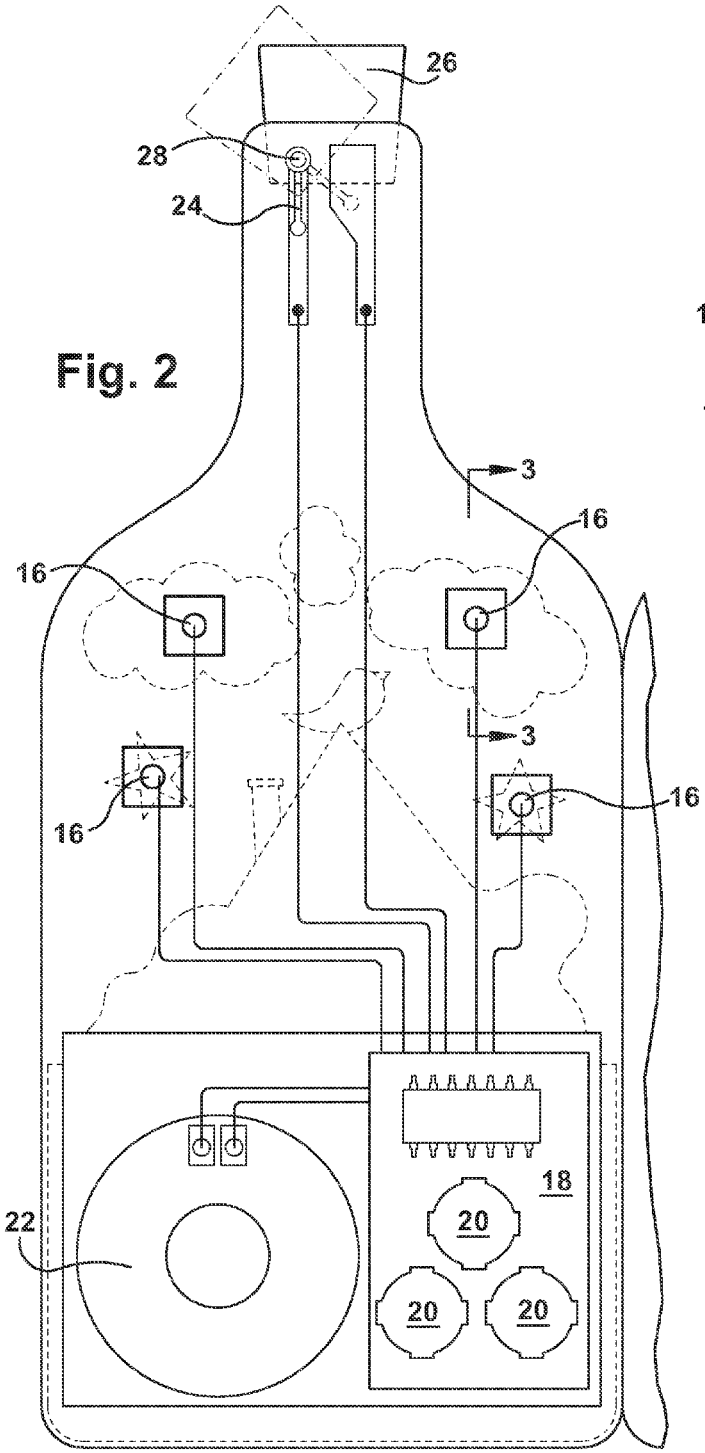
FIG. 2 is a front tear away view of the greeting card of FIG. 1.
Figure 3:
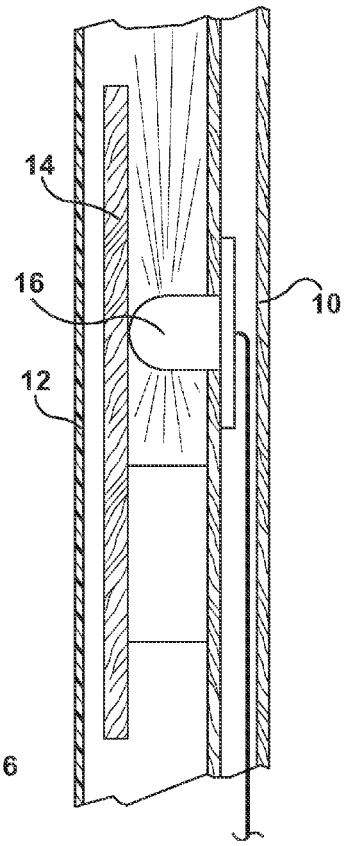
FIG. 3 is a side view of a portion of the greeting card of FIG. 1.

The greeting card of the present disclosure and related invention takes on the shape of a wine bottle with a faux cork that initiates audio playback and lighting effects with the faux cork is removed from the bottle.

The greeting card body 10 includes a contiguous two-panel greeting card die cut into the general shape of a bottle having a larger lower region tapering to a narrow neck portion at an upper region of the greeting card 100. The two panels 10, a left panel and a right panel, are connected along a main fold line. Each panel contains an inner surface and an outer surface opposite the inner surface. When the greeting card 100 is in a closed position the left panel is folded along the main fold line over the right panel such that the inner surface of the left panel is directly facing the inner surface of the right panel. The inner surface of the left and right greeting card panels serve as the inside of the greeting card 100 and the outer surface serves as the outside or front and rear cover the greeting card 100. The inner and outer surfaces of the greeting card body 10 may contain artwork, photos, and text sentiment, similar to a traditional greeting card.

A clear vacuum form 12, also shaped like a bottle (and the two-panel greeting card body 10), is attached to the front surface of the greeting card (also the outer surface of the left greeting card panel). The vacuum form 12 contains a substantially planar or flat front surface, which taper to a side or perimeter surface. When the vacuum form 12 is attached to the front surface of the greeting card 100 along its perimeter surface, an empty space or cavity exists between the front cover of the greeting card and the inside front surface of the vacuum form 12. In a preferred embodiment, the vacuum form 12 is made of clear plastic material but can also be made of another hardened, transparent material. The vacuum form 12 may cover the entire front surface of the greeting card body 10 or it may cover a substantial portion having a flared edge around the perimeter of the front greeting card surface.

Various die cut shapes 14 are arranged in the space or cavity between the greeting card body 10 and the vacuum form 12, creating a scenic landscape. For example, in one embodiment, the various die cut shapes 14 are arranged to form a beach scene (with sand, water, palm tree, boat, and other beach-related scenery). In another embodiment, the various die cut shapes 14 are arranged to form a scene with flowers and a birdhouse (with birdhouse, birds, flowers, grass and other related scenery). In a preferred embodiment, the die cut shapes 14 are made of paper, paperboard or other similar material. The die cut shapes 14 forming the themed scenery appear to be inside the "bottle" that is the combined greeting card body 10 and clear vacuum form 12. They are easily visible from the front of the greeting card 100 through the clear vacuum form 12 but are also protected at retail and during mailing by the hardened vacuum form 12. The die cut shapes 14 may be contained at various vertical and horizontal elevations within the cavity providing a three-dimensional effect.

The various die cut shapes 14 serve as a decorative element of the greeting card 100 but also serve to camouflage or conceal the greeting card's electronic components. The electronic components may include any device or mechanism that is necessary to or which facilitates the storage of and the replay of at least one audio file upon user interaction with the greeting card 100 and the flashing or illumination one or more miniature lights 16. These components may include, but are not limited to: a printed circuit board 18; an integrated circuit chip; a power source 20 such as one or more small cell batteries; a speaker 22; a memory storage device at least one audio file stored on the memory storage device; a switch or trigger mechanism 24; one or more miniature lights, such as light emitting diode (LED) lights and/or fiber optics 16. These and other related electronic components are known to one of ordinary skill in the art. A small foam piece or other such material may surround the various electronic components for added protection. The foam piece (or other material) may also be concealed behind a die cut shape 14 as part of the scenery.

One or more LED lights 16 are placed within the cavity between the greeting card body 10 and the vacuum form 12. The LED lights 16 may be placed behind the various die cut shapes 14 which make up the paper scene such that when the lights 16 are illuminated, the paper scene is back-lit. The lights 16 are connected to the integrated circuit chip and may be programmed with various lighting effects, such as for example blinking (repetitive on/off); twinkling (two or more lights with fast alternating blink); and slow glow (starts as dim light that progressively gets brighter). Different timing patterns may also be used with the various lighting effects. Each light 16 may have the same or different lighting effects. The lights 16 may be turned on or illuminated in a particular sequence or may all be turned on or illuminated at once. Additionally, one or more fiber optic strands may be interspersed within the paper scene. An LED light may be placed at the base of the one or more fiber optic strands so that when the LED lights are illuminated, the fiber optic strands will be illuminated as well. The fiber optic strands may be placed in a bundle with a single LED light at the base which will light each strand in the bundle.

A faux cork 26 is attached to the greeting card at a hinge or pivot point 28. The hinge or pivot point 28 may be attached to the front greeting card panel. The faux cork 26 is positioned at the top of the greeting card body 10 (at the opening at the neck of the bottle), having a portion beneath the clear vacuum form 12 (between the vacuum form and the front greeting card panel) and a portion which extends out or above the greeting card body 10 and vacuum form 12. In a first position, the cork 26 is in a substantially upright or vertical position. In a second position, the cork 26 is tipped to the right or pivoted along the hinge 28 such that a substantial portion of the cork 26 is outside of the greeting card and vacuum form 12. Movement between the first and second positions is intended to simulate a cork 26 being removed from a wine bottle. This movement between positions is also the trigger that initiates playback of audio and the illumination of one or more LED lights or fiber optics 16. Moving the cork 26 back from the second position to the original or first position causes the audio to cease playback and the lights 16 to be extinguished. The faux cork 26 may be made of wood, cork, paper, paperboard, plastic or other such material. A permanent sticker may be applied to the upper region or neck portion of the bottle (vacuum form 12) with printing thereon instructing the user to move the cork 26 for added entertainment. The printing may indicate "open me" or other similar phrase.

While a particular card construction, shape, decorative elements, switch types or trigger mechanism, and the location of electronic components have been particularly described herein and shown in the figures, other variations on these features have been contemplated and are considered to be within the scope of the present invention. It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

The invention claimed is:

1. A greeting card comprising:

a two-panel greeting card body in the shape of a bottle;

a vacuum form in the shape of a bottle attached of the front portion of the two-panel greeting card body;

a paper scene comprising one or more die cut shapes located in a cavity created between the two-panel greeting card body and the vacuum form;

an electronics module operative to store and playback audio;

one or more LED lights;

a faux cork which is operative to move between a first position wherein it is partially contained within the cavity between the two-panel greeting card and the vacuum form and a second position wherein it is substantially outside of the cavity;

wherein moving the faux cork from the first position to the second position initiates playback of the audio and illumination of the one or more LED lights or fiber optics.

2. The greeting card of claim 1, wherein the faux cork is attached to the two-panel greeting card body at a pivot point.

3. The greeting card of claim 1 further comprising one or more fiber optic strands locate within the cavity between the two-panel greeting card body and the vacuum form.

4. The greeting card of claim 1, wherein the cork is not detachable from the two-panel greeting card body.

5. The greeting card of claim 1, wherein the one or more LED lights are located behind one of the one or more die cut shapes.

6. The greeting card of claim 1, wherein the LED lights may be programmed to flash or blink.

7. The greeting card of claim 1 further comprising a piece of foam located within the cavity between the two-panel greeting card body and the vacuum form which surrounds the electronics module.

8. A greeting card comprising:

a greeting card shaped like a bottle;

a plastic cover attached to a front surface of the greeting card creating a cavity therebetween;

a paper scene located in the cavity;

one or more LED lights contained within the cavity;

an electronics module contained within the cavity, the electronics module operative to store and playback pre-recorded audio;

a faux cork hingedly attached to a top portion of the greeting card beneath the plastic cover;

wherein when the faux cork is moved to the right about a hinge, playback of the prerecorded audio is initiated and the one or more LED lights are illuminated.

9. The greeting card of claim 8, wherein the paper scene comprises a plurality of die cut shapes.

10. The greeting card of claim 9, wherein the plurality of die cut shapes are placed at different horizontal and vertical elevations such that the paper scene appears to be three dimensional.

11. The greeting card of claim 8, wherein the one or more LED lights are placed behind the paper scene.

12. The greeting card of claim 8, wherein the one or more LED lights may be programmed with different lighting effects selected from the list of: blinking; flashing; twinkling; and slow glow.

13. The greeting card of claim 8 further comprising one or more fiber optic strands located within the paper scene.

14. The greeting card of claim 8, wherein the one or more LED lights may be illuminated in sequence.

15. A greeting card comprising:

a greeting card having two or more panels and a plastic cover attached to the front face thereof creating a cavity therebetween;

a paper scene contained within the cavity, the paper scene comprising two or more themed die cut shapes;

a sound module contained within the cavity operative to store and playback an audio file;

a trigger mechanism which is attached to the greeting card between the greeting card and the plastic cover, the trigger mechanism operative to move from a first position wherein it is partially contained within the cavity and a second position wherein it is substantially removed from the cavity;

wherein when the trigger mechanism is moved from the first to the second position, playback of the audio file is initiated.

16. The greeting card of claim 15 further comprising one or more LED lights contained within the cavity.

17. The greeting card of claim 16, wherein the one or more LED lights are illuminated upon moving the trigger mechanism from the first to the second position.

18. The greeting card of claim 15 further comprising one or more fiber optic strands contained within the cavity.

19. The greeting card of claim 18, wherein the one or more fiber optic strands are illuminated upon moving the trigger mechanism from the first to the second position.

20. The greeting card of claim 15, wherein the greeting card and plastic cover are shaped like a bottle.

* * * * *